United States Patent [19]

Sarcia

[11] 4,091,264

[45] May 23, 1978

[54] HEAT TRANSFER

[75] Inventor: Domenico S. Sarcia, Carlisle, Mass.

[73] Assignee: Seal Incorporated, Naugatuck, Conn.

[21] Appl. No.: 714,009

[22] Filed: Aug. 13, 1976

[51] Int. Cl.[2] ..... B21B 27/06

[52] U.S. Cl. ..... 219/469; 165/89; 165/105

[58] Field of Search ..... 165/105, 89, 90; 219/469–471

[56] References Cited

U.S. PATENT DOCUMENTS

| | | | |
|---|---|---|---|
| 2,843,715 | 7/1958 | Paley | 219/366 |
| 3,651,240 | 3/1972 | Kirkpatrick | 165/105 X |
| 3,658,125 | 4/1972 | Freggins | 165/105 X |
| 3,952,798 | 4/1976 | Jacobson et al. | 165/105 |

FOREIGN PATENT DOCUMENTS

| | | | |
|---|---|---|---|
| 1,544,792 | 9/1968 | France | 219/469 |
| 324,801 | 9/1920 | Germany | 219/469 |

*Primary Examiner*—Albert W. Davis, Jr.
*Attorney, Agent, or Firm*—Schiller & Pandiscio

[57] ABSTRACT

A heat transfer roller embodying a heat pipe is disclosed. The heat pipe is mounted on a shaft, and the shaft is adapted for rotation on its axis.

17 Claims, 3 Drawing Figures

HEAT TRANSFER

This invention relates to heat transfer rollers and more particularly to heat transfer rollers which are particularly adapted for use in laminators or other applications where high heat transfer rate and uniform heat transfer are required.

Heat transfer rollers have wide application in industry, for example, in laminating sheet material. Ideally, a heat transfer roller should have capacity to transfer high quantities of thermal energy uniformly and rapidly from its surface. Known heat transfer rollers are not entirely satisfactory in achieving these goals.

It is thus a primary object of the present invention to provide a new and improved heat transfer roller which is characterized by a high and uniform thermal transfer capacity. Another object of the invention is to provide a heat transfer roller which is particularly adapted for use in laminating sheet material.

These and other objects of the invention are achieved by a heat transfer roller which basically embodies a heat pipe mounted on a shaft for rotation on its axis.

Other features and many of the advantages of the invention are disclosed or rendered obvious by the following detailed specification which is to be considered together with the accompanying drawings wherein.

Figure 1:
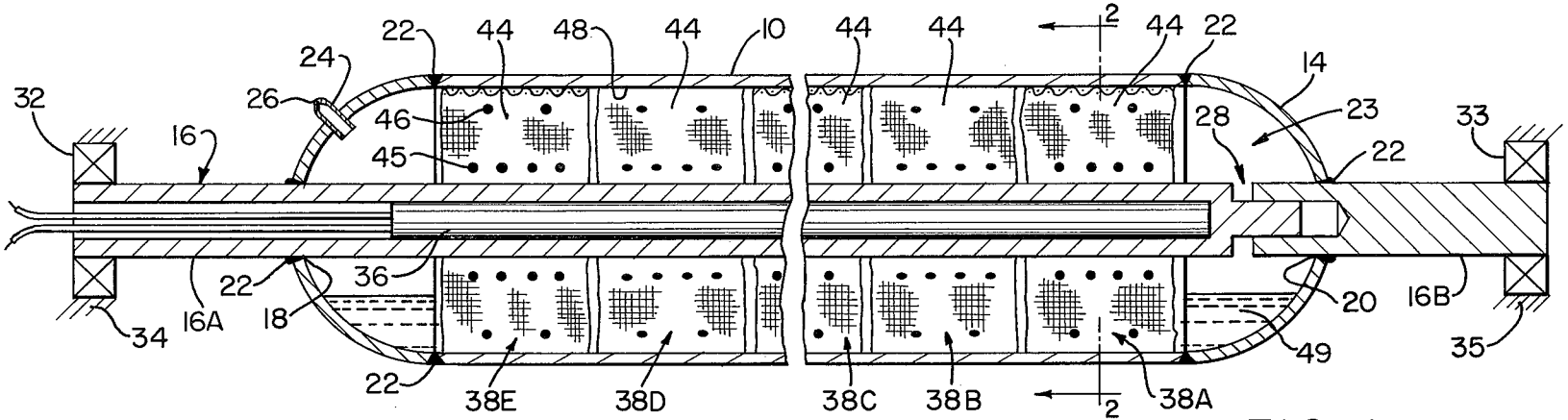
FIG. 1 is a side-elevational view, in section, of a preferred embodiment of heat pipe roller made in accordance with the invention.

Heat pipes are known per se in the art. A principal feature of a heat pipe which renders it particularly advantageious for use in providing a heat transfer roller in accordance with the instant invention, is its capacity to provide effective thermal conductance and thermal energy transport efficiencies that are several orders of magnitude greater than the effective thermal conductance and transport efficiencies of solid metal heat source. Generally, a heat pipe comprises a hermetically sealed housing or casing which defines a heat input region and a heat rejection region. A heat transfer fluid, or so-called "working fluid" is contained in the housing. In operation, the working fluid is heated to the vapor phase at the heat input region. The vapor then moves to the slightly lower temperature heat rejection region, where the fluid condenses as it supplies heat of evaporation to the heat rejection region. The resulting condensate is then recovered and returned to the heat input region via a wicking structure. Such heat pipes and suitable working fluids, for example, in U.S. Pat. Nos. 3,232,159, 3,587,725, 3,746,081, 3,749,159, and the various U.S. patents referred to therein.

In the drawings, like numbers refer to like parts.

Turning now to FIG. 1, the heat pipe roller provided in accordance with the present invention comprises an elongated cylindrical housing 10 which is closed at its ends by hemispherical caps 12 and 14, respectively. Housing 10 is concentric with an elongated shaft 16 which extends through holes 18 and 20 formed centrally in caps 12 and 14 respectively. Housing 10, end caps 12 and 14 and shaft 16 are all formed of a rigid material of high thermal conductivity, e.g. steel, and are welded together as shown by weld beads 22 so as to form a hermetically sealed chamber 23.

An inlet tube 24 is fixed in a tube in the wall of one of the end caps, e.g. end cap 12, for introducing a volatile working fluid into the sealed chamber 23. As is well known to one skilled in the art, the choice of a working fluid is dependent on physical properties of the fluid and compatibility of the fluid with the wicking structure. Among properties which will be considered by one skilled in the art are: vapor pressure, thermal conductivity, viscosity, and density of vapor and liquid (see Heat Transfer Agents for High-Temperature Systems, by Joel R. Fried, *Chemical Engineering,* May 28, 1973; the Heat Pipe by K. T. Feldman et al, *Mechanical Engineering,* February 1967, pages 30–33; and the U.S. patents listed hereinabove). The choice of working fluid per se forms no part of the instant invention. Tube 24 is closed off after the working fluid has been added to chamber 23, e.g., by pinching off and welding shut the end of the tube at 26.

As seen in FIG. 1, shaft 16 comprises two axially aligned sections 16A and 16B which are slidably connected to one another by a slip joint 28 adjacent one end of the housing, e.g. just under end cap 14. Slip joint 28 allows for differences in the thermal expansion of the shaft and the housing when the heat pipe roller is heated to operating temperature (typically the temperature difference between shaft 16 and cylindrical surface of housing 12 may be the order of 100° F). The assembled shaft 16 is long enough for its ends to project out from the end caps as shown. Shaft 16 is adapted for rotation on its axis. According to the preferred form of the invention, the ends of the shaft are mounted in suitable bearings 32 and 33. Bearings 32 and 33 are attached to and supported by a pair of suitable stationary supports such as members 34 and 35 respectively which, for example, may be part of the frame of a roller-type laminating machine.

The heat pipe roller also includes means for supplying heat to shaft 16. Preferably such heating means is in the form of an elongate electrical resistance heater 36 disposed within hollow shaft section 16A. Obviously, other means may be employed for supplying heat to shaft 16. For example, one or both ends of shaft 16 extending beyond caps 12 and 14 may be heated by burners (not shown), in which case the heat will be carried to the central region of the shaft by conduction.

One skilled in the art will recognize that the exterior surface of shaft 16 within chamber 23 defines a heat input region while the interior surface of housing 10 defines a heat rejection region of the heat pipe.

As is known in the art, the thermal energy transport efficiency of a heat pipe generally is a function of the rate of circulation of the heat transfer fluid between the heat rejection and heat input sections of the heat pipe and also of the latent heat of evaporation of the heat transfer fluid. The driving force for inducing flow of heat transfer fluid vapors from the heat input region to the heat rejection region is provided by the vapor pressure differential existing between the heat input and heat rejection regions, which in turn is dependent on temperature differences between those regions. The liquid transporting efficiency of the wicking structure also is important since it determines to a large extent the rate of return of condensed working fluid from the heat rejection region to the heat input region. In this regard an excessively thick wicking structure may impede flow of working fluid vapors between the heat input and heat rejection regions of the pipe. On the other hand, if the wicking structure is inadequate, return of condensed fluid to the heat input region may be impeded. It is also desirable to provide for removal of condensed heat transfer fluid from the heat section region as soon as possible after the condensate forms on the heat rejection region, so that a substantially bare surface for condensation will be maintained with heat conduction being required only through a very thin liquid film. This latter requirement can be met by providing a wicking structure which has a good liquid transporting efficiency, and by providing a good fluid couple between the wicking structure and the heat rejection region where the working fluid condenses.

In accordance with this invention, the illustrated apparatus includes a novel wicking structure which provides effective collection and removal of condensed heat transfer fluid from the heat rejection region of the heat pipe and return of the condensed fluid to the heat input region, with minimum impedance to the flow of hot vapor to the heat rejection region.

Figure 2:
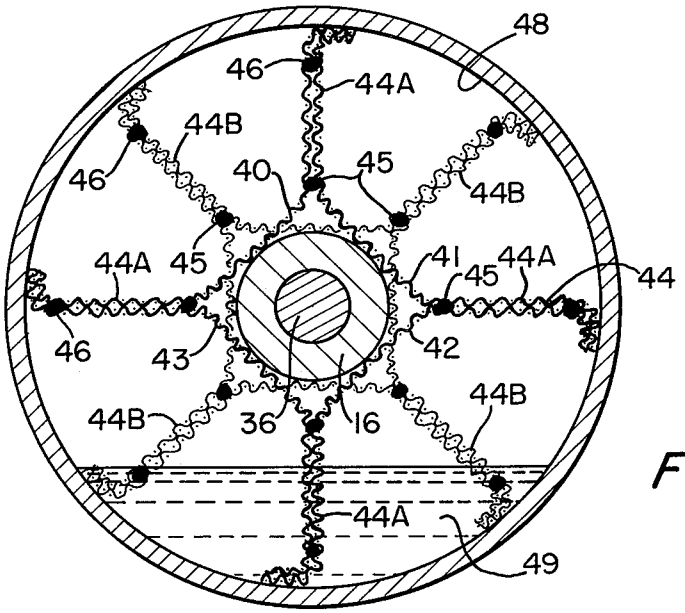
FIG. 2 is a cross-sectional view taken along line 2—2 of FIG. 1.

As shown in FIGS. 1 and 2, the novel wicking structure comprises four like wicking units 38A, B, C and D distributed along shaft 16. Each wicking unit is arranged to extend radially between shaft 16 and housing 10 and, in the preferred embodiment shown in the drawings, each wicking unit is made by providing four individual sheets 40, 41, 42 and 43 of stainless steel screen or mesh and bending and arranging them so that each sheet has its appropriate ends overlapping and connected to the ends of two other sheets, whereby to form four equally-spaced, two-ply vanes 44 that extend radially between shaft 16 and housing 10.

For purposes of clarity, in FIG. 2 the vanes of wicking units 38A and 38B are identified as 44A and 44B respectively.

The overlapping sections of the sheets of screen material are connected together by spot welding as shown at 45 and 46 or by other suitable means, e.g., by rivets. Spot welds 45 are located so that the center sections of the four sheets form a tube-like structure about shaft 16. The center sections of sheets 40 – 43 lie close to and preferably engage shaft 16. Preferably also the the sheets are long enough so that the outer ends of vanes 44 can be bent to lie against the inner surface 48 of housing 10. It is to be noted also that the four wicking units are displaced angularly from one another about the axis of shaft 16, whereby the vanes of each unit are offset or non-aligned with the vanes of each adjacent wicking unit. Thus, as shown in FIG. 2, each vane 44A is displaced from each corresponding vane 44B by an angle of about 45°. Although not shown, it is to be understood that the vanes of wicking unit 38C are correspondingly displaced from the vanes of wicking units 38A and D, with the result that the vanes of units 38A and B are aligned with vanes of units 38C and D respectively. The wicking units are preferably made of a stainless steel screen or mesh since such material offers the advantage of being strong, self-supporting, capable of being bent to a suitable shape and of retaining such shape, and available in suitable mesh size. The mesh size or porosity of the screen or mesh material is selected so as to assure that the desired wicking action will be obtained for the particular working fluid that is employed.

The individual wicking units are pre-formed and then slipped onto shaft 16. However, each wicking unit may be built directly around shaft 16. In any event, the wicking units are required to rotate with housing 10. This requirement may be satisfied by making vanes 44 long enough so that their outer ends frictionally grip the inner surface of housing 10 and/or by making the center section of sheets 40 – 43 frictionally grip shaft 16. It also is contemplated that the wicking units may be spot welded to shaft 16 and/or housing 10. End caps 12 and 14 are assembled to housing 10 by welding as previously described after the wicking units are in place. Thereafter, chamber 23 is evacuated of air and charged via tube 24 with a quantity of a selected heat transfer fluid that is sufficient to wet the entire surface of the wicking structure and also maintain a pool of the fluid at the bottom of chamber 23 as shown at 49 in FIG. 2. The tube 24 is closed off as previously described to prevent the fluid from escaping from chamber 23.

Figure 3:
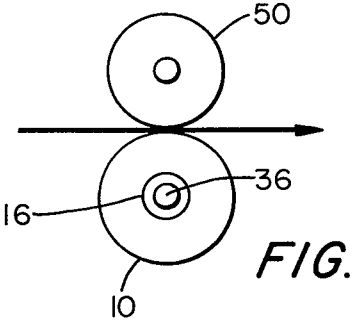
FIG. 3 is a cross-sectional view illustrating the heat pipe roller of FIG. 1 in pressure engagement with a second roller.

FIG. 3 illustrates how the heat pipe roller of the present invention may be used in a laminating operation. In such case the heat pipe roller is mounted in contact with a pressure roller 50. Suitable means (not shown) are provided for biasing roller 50 into pressure engagement with the heat pipe, and also for driving roller 50. The workpiece to be heated and pressure laminated is fed between the engaged rollers and subjected thereby to heat and pressure. As the heat pipe roller rotates, the vanes 44 pass through the pool 49 of liquid which remains stationary. The working liquid is picked up by the immersed portions of the vanes and then moves by capillary action inwardly along the vanes toward shaft 16. As the liquid contacts or comes near to shaft 16, it is heated up enough to be vaporized. The vapor contacts the exposed inner surface 48 of housing 10 and thereby transmits heat to the latter member. Simultaneously housing 10 rejects heat by transferring it to the workpiece and also to the adjacent roller 50. As quickly as a portion of the housing 10 gives up heat, additional heat is supplied to it by the vaporized fluid to balance its heat loss. The vaporized fluid condenses as it gives up its heat of vaporization and the condensate automatically falls back into pool 49 to continue the wicking and vaporizing action.

One skilled in the art will recognize a number of advantages that a heat pipe roller made in accordance with the present invention has over prior heat rollers. For one thing, the heat pipe roller may be made using readily available materials. Another advantage is that a portion of the wicking structure is always in contact with the pool of working fluid and this tends to improve the speed and efficiency with which liquid is picked up and vaporized. Moreover, the wicking structure occupies a relatively small space within the working volume of the heat pipe roller so that flow resistance of the heated working fluid vapor is minimal. The wicking structure also functions as a paddle wheel as the heat pipe roller is rotated, and this increases the rate of pick-up of condensed liquid from pool 49. The uniformity and efficiency of heat transfer also is improved by offsetting the vanes of one wicking unit relative to the vanes of adjacent units.

Another advantage is that any one of a number of vaporizable working fluids may be used in practicing the invention.

Although only a single embodiment of the invention has been shown, one skilled in the art will recognize various modifications which are possible without departing from the scope of the present invention. For example, the wicking structure may comprise any number of radially extending members, e.g. 3, 5, or more and/or it may consist of a single unit extending for the full length of housing 10. Moreover, the wicking members need not comprise stainless steel screen in radial arrangement as shown; other porous materials in other arrangements well known in the art may be employed as the wicking structure in accordance with the present invention.

Other modifications and variations of the apparatus described herein will be apparent to persons skilled in the art. For example, a metal bellows (not shown) may be employed in conjunction with shaft 16 in place of slip joint 28 to allow for thermal expansion. Therefore, the invention should be considered as including all modifications, variations and alternative forms falling within the scope of the appended claims.

What is claimed is:

1. A heat pipe roller which comprises:

an elongated cylindrical hollow housing closed at its ends defining a heat rejection region;

an elongated shaft extending through said housing, said shaft being attached to and supporting said housing, said shaft defining a heat input region spaced from said heat rejection region;

a volatile working fluid disposed within said housing; and a wicking structure within said housing extending between said heat input region and said heat rejection region for collecting said working fluid when the latter is in a liquid state and for carrying said liquid state fluid to said heat input region for vaporization as said housing is rotated, said wicking structure comprising a plurality of members in contact with said housing, said members being disposed in groups, said groups being arranged in side-by-side relation along the long axis of said shaft, the members of one group being staggered relative to members of an adjacent group.

2. A heat pipe roller according to claim 1 wherein said wicking structure comprises stainless steel screen.

3. A heat pipe roller according to claim 1 wherein said elongated shaft is adapted for rotation on its axis.

4. A heat pipe roller according to claim 3 further including shaft supporting means, and bearing means rotatably mounting said shaft to said shaft supporting means.

5. A heat pipe roller according to claim 1 further including a heater element for supplying heat to said heat input region.

6. A heat pipe roller according to claim 5 wherein said heater element is an elongate electrical resistance heater mounted within said shaft.

7. A heat pipe roller according to claim 1 wherein said housing comprises an elongated hollow tube and end members closing off the ends of said tube, and said shaft extends through said end members.

8. A heat pipe roller according to claim 1 wherein said wicking structure members are disposed so as to extend substantially radially outwardly from said shaft between said heat input region and said heat rejection region.

9. A heat pipe roller acccording to claim 1 wherein said elongated shaft includes an area which allows for thermal expansion of the shaft interior of said housing.

10. A heat pipe roller which comprises:

an elongated cylindrical hollow housing closed at its ends defining a heat rejection region;

an elongated shaft extending through said housing, said shaft being attached to and supporting said housing, said shaft including an area which allows for thermal expansion of the shaft intermally of said housing said shaft defining a heat input region spaced from said heat rejection region;

a heater element in the form of an elongate electrical resistance heater mounted centrally within said shaft for supplying heat to said input region;

a volatile working fluid disposed within said housing; and a wicking structure within said housing and extending between said heat input region and said heat rejection region for collecting said working fluid when the latter is in a liquid state and for carrying said liquid state fluid to said heat input region for vaporization as said housing is rotated.

11. A heat pipe roller according to claim 8 wherein said wicking structure comprises a plurality of members in contact with said housing.

12. A heat pipe roller according to claim 8 wherein said wicking structure comprises stainless steel screen.

13. A heat pipe roller according to claim 8 wherein said elongated shaft is adapted for rotation on its axis.

14. A heat pipe roller according to claim 13 further including shaft supporting means, and bearing means rotatably mounting said shaft to said shaft supporting means.

15. A heat pipe roller according to claim 8 wherein said housing comprises an elongated hollow tube and end members closing off the ends of said tube, and said shaft extends through said end members.

16. A heat pipe roller according to claim 8 wherein said wicking structure members are disposed so as to extend substantially radially outwardly from said shaft between said heat input region and said heat rejection region.

17. A heat pipe roller according to claim 16 wherein said wicking structure members are disposed in groups, said groups being arranged in side-by-side relation along the long axis of said shaft, the members of one group being staggered relative to members of an adjacent group.

* * * * *